US007113131B2

(12) United States Patent
Burke

(10) Patent No.: US 7,113,131 B2
(45) **Date of Patent: *Sep. 26, 2006**

(54) METALIZED DIELECTRIC SUBSTRATES FOR EAS TAGS

(75) Inventor: Thomas F. Burke, Wayland, MA (US)

(73) Assignee: Micrometal Technologies, Inc., Newburyport, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/016,051

(22) Filed: Dec. 17, 2004

(65) Prior Publication Data

US 2005/0129842 A1 Jun. 16, 2005

Related U.S. Application Data

(63) Continuation of application No. 10/137,195, filed on May 2, 2002, now Pat. No. 6,835,412.

(51) Int. Cl.
*H01Q 1/38* (2006.01)
*G08B 13/14* (2006.01)
*B05D 5/12* (2006.01)

(52) U.S. Cl. ..... 343/700 MS; 340/572.8; 427/116

(58) Field of Classification Search ..... 343/700 MS, 343/895; 340/572.8; 427/116
See application file for complete search history.

(56) References Cited

U.S. PATENT DOCUMENTS

| | | | | |
|---|---|---|---|---|
| 3,397,085 | A * | 8/1968 | Cariou et al. | 427/81 |
| 4,001,871 | A | 1/1977 | Tsunemitsu | 357/54 |
| 4,498,076 | A | 2/1985 | Lichtblau | 340/572 |
| 4,560,445 | A | 12/1985 | Hoover et al. | 205/126 |
| 4,583,099 | A | 4/1986 | Reilly et al. | 343/895 |
| 4,797,785 | A | 1/1989 | Jorgensen | 361/402 |
| 4,936,957 | A | 6/1990 | Dickey et al. | 204/37.1 |
| 5,442,334 | A | 8/1995 | Gallo et al. | 340/572 |
| 5,574,470 | A | 11/1996 | de Vall | 343/895 |
| 5,589,251 | A | 12/1996 | Imaichi et al. | 428/209 |
| 5,608,417 | A | 3/1997 | de Vall | 343/895 |
| 5,688,606 | A | 11/1997 | Mahulikar et al. | 428/615 |
| 5,841,075 | A * | 11/1998 | Hanson | 174/250 |
| 5,841,350 | A | 11/1998 | Appalucci et al. | 340/572.3 |
| 5,861,809 | A | 1/1999 | Eckstein et al. | 340/572.3 |
| 5,920,290 | A | 7/1999 | McDonough et al. | 343/873 |
| 6,042,929 | A | 3/2000 | Burke et al. | 428/141 |
| 6,091,607 | A | 7/2000 | McKeown et al. | 361/777 |
| 6,203,891 | B1 * | 3/2001 | Noddin | 428/209 |
| 6,313,747 | B1 | 11/2001 | Imaichi et al. | 340/572.5 |
| 6,383,616 | B1 | 5/2002 | Uchibori | 428/209 |
| 6,835,412 | B1 * | 12/2004 | Burke | 427/116 |

* cited by examiner

*Primary Examiner*—Shih-Chao Chen
(74) *Attorney, Agent, or Firm*—Weingarten, Schurgin, Gagnebin & Lebovici LLP

(57) ABSTRACT

A metallized substrate, such as used to make a resonant circuit tag with inductive and capacitive elements in series, has a thin inorganic or polymeric dielectric layer formed on a metal layer. The inorganic layer may be formed by anodizing a surface of the metal layer. The organic layer may be formed by flexographic printing. In both cases, a via hole is formed through the dielectric layer. A second layer of very thin conductive metal is deposited on the dielectric layer and in the via hole. The substrate is subsequently patterned with an etch resist and then etched to form the inductor coil and the capacitor plates, which are interconnected via the metallized via hole.

20 Claims, 3 Drawing Sheets

METALIZED DIELECTRIC SUBSTRATES FOR EAS TAGS

CROSS REFERENCE TO RELATED APPLICATIONS

This application is a continuation of U.S. application Ser. No. 10/137,195 filed May 2, 2002 U.S. Pat. No. 6,835,412, and claims priority of U.S. Provisional Patent Applications Ser. No. 60/288,941 filed May 4, 2001 and Ser. No. 60/309,651 filed Aug. 2, 2001, the disclosures of which are incorporated by reference herein.

STATEMENT REGARDING FEDERALLY SPONSORED RESEARCH OR DEVELOPMENT

N/A

FIELD OF THE INVENTION

The present invention relates to metalized dielectric substrates and their utility in radio frequency electronic article surveillance tag circuits.

BACKGROUND OF THE INVENTION

The use of electronic article surveillance or security systems for detecting and preventing theft or unauthorized removal of articles or goods from retail establishments and/or other facilities, such as libraries, has become widespread. In general, such systems, sometimes called EAS systems, employ a label or security tag, also known as an EAS tag, that is affixed to, associated with, or otherwise secured to an article or item to be protected or its packaging. Security tags may take on many different sizes, shapes, and forms, depending on the particular type of security system in use, the type and size of the article, etc. In general, such security systems are employed for detecting the presence or absence of an active security tag as the security tag and the protected article to which it is affixed pass through a security or surveillance zone or pass by or near a security checkpoint or surveillance station.

The security tags that are the subject of this invention are designed to work with electronic security systems that sense disturbances in radio frequency (RF) electromagnetic fields. Such electronic security systems generally establish an electromagnetic field in a controlled area defined by portals through which articles must pass in leaving the controlled premises. A resonant tag circuit is attached to each article, and the presence of the tag circuit in the controlled area is sensed by a receiving system to denote the unauthorized removal of an article. The tag circuit is deactivated, detuned or removed by authorized personnel from any article authorized to leave the premises to permit passage of the article through the controlled area with alarm activation. Most of the tags that operate on this principle are single-use, i.e., disposable tags, and are therefore designed to be produced at low cost in very large volumes.

In conventional practice, the inductor and capacitor elements that comprise the resonant circuit are fabricated by etching both sides of a substrate that consists of a 1 mil thick layer of polyethylene sandwiched between two layers of aluminum foil.

FIG. 1A is a scaled illustration of one side of a typical 1.5" square RF tag showing a nine turn inductor coil on a 40 mil pitch, i.e., with 25 mil wide conductors separated by 15 mil spaces. FIG. 1A also depicts a triangular-shaped interconnection land area in one corner, and, positioned in the open space at the center of the coil, a capacitor plate. FIG. 1B illustrates the second side patterned with a matching capacitor plate in the center and a connecting link to the land area in the corner of the tag where a mechanical connection, typically formed by crimping or staking, joins the circuit patterns on side one to those on side two. Alternatively, the capacitor plate can be located outside the inductor coil in a corner of the tag but this configuration requires that the inductor pattern assume a roughly triangular shape. However, because planar inductor performance is optimized by placing as many coil turns as possible near the periphery of a square pattern, both of these design approaches are compromised by the need to devote tag surface area to the capacitor and interconnect functions.

Deactivation of these tags by direct means is problematic. Physical removal of tags that are adhesively or mechanically affixed to the protected article can be difficult and time consuming. Detuning the security tag by covering it with a special shielding device such as a metalized sticker is also time consuming and inefficient. Furthermore, both of these deactivation methods require the security tag to be identifiable and accessible, which prohibits the use of tags embedded within merchandise at undisclosed locations or tags concealed in or upon the packaging.

Improved deactivation methods incorporate remote electronic deactivation of a resonant tag circuit such that the deactivated tag can remain on an article properly leaving the premises. An example of such a deactivation system is described in U.S. Pat. No. 4,728,938 (Kaltner, 3/1988). Electronic deactivation of a resonant security tag involves changing or destroying the detection frequency resonance so that the security tag is no longer detected as an active security tag by the security system. There are many methods available for achieving electronic deactivation. In general, however, the known methods involve either short circuiting a portion of the resonant circuit or creating an open circuit within some portion of the resonant circuit to either spoil the Q of the circuit or shift the resonant frequency out of the frequency range of the detection system, or both.

A method of deactivating a tag by short circuiting a portion of its resonant circuit is disclosed in U.S. Pat. No. 4,498,076 (Lichtblau, 2/1985) entitled "Resonant Tag and Deactivator for Use in Electronic Security system" and U.S. Pat. No. 4,567,473 (Lichtblau, 1/1986) entitled "Resonant Tag and Deactivator for Use in Electronic Security System". In this approach an indentation or dimple is made within the plates that form the capacitor portion of the resonant circuit. At energy levels higher than the detecting signal but within FCC regulations the deactivation device induces a voltage in the resonant circuit of the tag sufficient to cause the dielectric layer between the plates to break down in the area where the indentation has reduced the thickness of the dielectric layer. This type of security tag can be conveniently deactivated at a checkout counter or other such location by being momentarily placed above or near the deactivation device.

However, tags made by this method, which requires the precise formation of an approximately 0.1 mil indented thickness in a polymer layer that is typically only 1 mil thick to begin with, may not always function as designed. For example, if the indentation is not deep enough, i.e., if the polymer dielectric layer under the indentation is thicker than intended, the energy provided by the deactivating device may not be sufficient to cause breakdown of the dielectric layer. In retail establishments, this circumstance can lead to an embarrassing confrontation of innocent customers by store security personnel. On the other hand, if the indentation is too deep, i.e., the polymer dielectric layer under the indentation is thinner than intended, the tag may be prematurely deactivated by exposure to the lower energy detection signal emanating from the portals or the static charge that can build up on the packaging machinery used to automatically apply tags configured as product identification or pricing labels. In this case, retailers are not getting the protection they are paying their packaging suppliers to provide. Thus, with respect to the deactivation reliability of conventional EAS RF tags, no completely satisfactory method has emerged nor has the prior art taken the specific form of the novel approach proposed in this invention.

Retailers who employ anti-pilferage systems based on RF technology would like the tags that are used in these systems to be smaller in size, preferably 1" square, so that they can be more easily concealed on or in the protected merchandise. They also perceive that smaller tags would consume less material and therefore cost less to produce. FIG. 2 is a scaled illustration of a 1" square tag patterned with a nine turn 40 mil pitch inductor coil per FIG. 1A. However, as the overlay in this illustration reveals, it is impossible to repackage the coil geometry shown in FIG. 1A into a 1" square format using the same conductor pitch. This is due to the fact that the resonant frequency of a tag circuit is defined as: $F=\frac{1}{2\pi\sqrt{LC}}$. Consequently, if L is reduced, C must increase by an offsetting amount if the resonant frequency of the circuit is to remain unchanged. In this example, conversion from a 1.5" to 1.0" format will reduce L by a factor of roughly 2, so C must increase by the same factor. C is defined as: $C=k*A/t$, where k is the dielectric constant of the polymer material, t is the thickness of the polymer layer, and A is the area of the capacitor plate. K is of course fixed by the choice of polymer material but in conventional practice t is effectively fixed at 1 mil by the laminating methods used to fabricate the substrate material. Plate area is therefore the only variable available to increase C. However, as illustrated by the overlay in this Figure, doubling the plate area of the capacitor in a 1" square tag format requires the elimination of several coil turns, which significantly reduces the effective operating range of the tag circuit. Furthermore, as indicated by the overlay in the upper left-hand corner, the number of turns and shape of the coil pattern in a 1" square format will also be adversely affected by the surface area that must be devoted to the mechanical interconnection. These consequences undoubtedly explain why the production of conventional RF tags remains standardized on a nominal 1.5" square design format despite the fact that tags of this kind were developed and introduced to the market more than twenty years ago.

Thus, with respect to size as well as deactivation reliability, no completely satisfactory RF tag design for electronic article surveillance applications has emerged nor has the prior art recognized the novel approach of this invention.

SUMMARY OF THE INVENTION

The invention features a metalized substrate of a thin inorganic or polymeric dielectric material clad on both sides with metal and the advantages obtained by fabricating such a substrate material into a tuned or resonant circuit tag, generally defined by at least one inductive and capacitive element arranged in series. The construction and function of the tag circuits themselves are known, as disclosed in the aforementioned patents.

One of the objectives of the present invention is the provision of a technique and article by which the reliability and the facility of the tag deactivating process is improved. To that end, the present invention departs from conventional practice and the prior art in that a very thin layer of dielectric material containing a very small opening or so-called via hole is formed directly on a first layer of conductive foil and a second layer of very thin conductive metal is deposited on the dielectric layer and in the via hole to effect the interconnection of the two conductive layers. This substrate construction is subsequently patterned with an etch resist, and then etched to form the inductor and capacitor plates that constitute the elements of the resonant circuit. Unlike conventional practice, wherein the reliability of the tag deactivation process is compromised by the need to precisely deform a thin polymeric layer by mechanical means, the deactivation reliability of tag circuits made from this construction is enhanced by the uniformity and consistency with which the critical breakdown thickness of its dielectric layer is formed by non-mechanical means. The formation of the small via hole in the dielectric layer has a derivative benefit in that it also eliminates the need to devote tag surface area on the inductor side to the formation of a mechanical interconnect.

Another object of the present invention is the reduction of tag surface area that must be devoted to the capacitor plate on the inductor side so that the inductance of the coil, a property directed related to the square of the number of turns in the coil, can be maximized for any size tag but particularly for tags smaller than 1.5" square. In conventional practice, the use of a 1 mil thick polymer dielectric layer produces a requirement for a capacitor plate and its attendant connections that can occupy nearly 10% of the overall area of a 1.5" square tag. For 1" square tag designs, which have only 40% of the area of the 1.5" square tag to begin with, reliance on a 1 mil thick polymer dielectric layer leads to even larger capacitor plates that consume nearly 50% of the available surface area. These consequences are almost entirely eliminated in the present invention because the use of a very thin dielectric layer produces a requirement for a very small capacitor plate, one that is only a tiny fraction of the size of its conventional counterpart. The size of this tiny capacitor element is such that, regardless of its location relative to the inductor coil, it maximizes the surface area, hence number of coil turns that can be devoted to the layout of the inductor pattern. This inductance-enhancing feature can be exploited to increase the detection range of a given size tag or to produce smaller tags with the same detection range.

BRIEF DESCRIPTION OF THE SEVERAL VIEWS OF THE DRAWING

The foregoing summary, as well as the following detailed description of preferred embodiments of the invention, will be better understood when read in conjunction with the appended drawings, in which.

DETAILED DESCRIPTION OF THE INVENTION

Figure 1B:
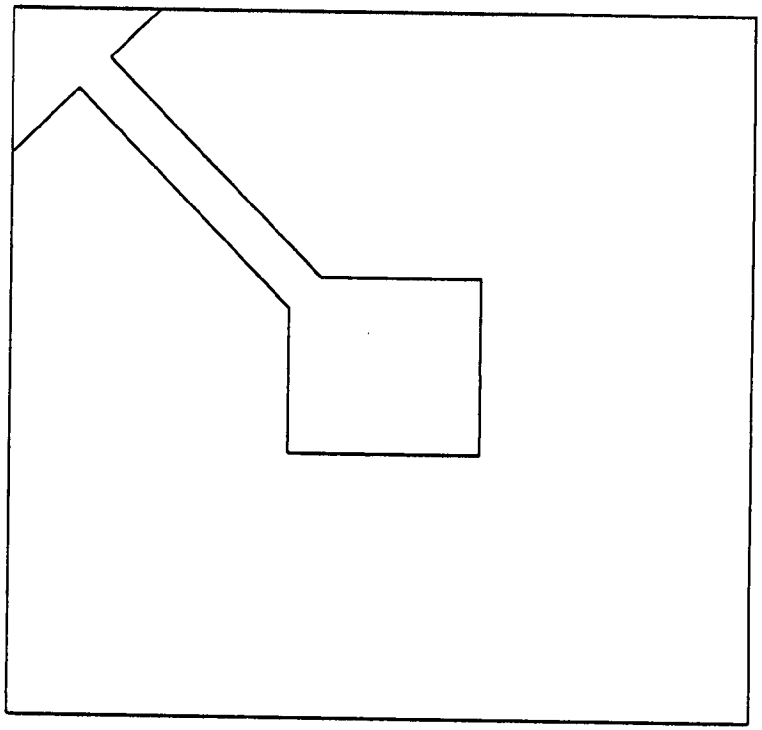
FIG. 1B PRIOR ART
FIG. 1B is an enlarged plan view of a second side of the printed circuit security tag of FIG. 1A.
Figure 1A:
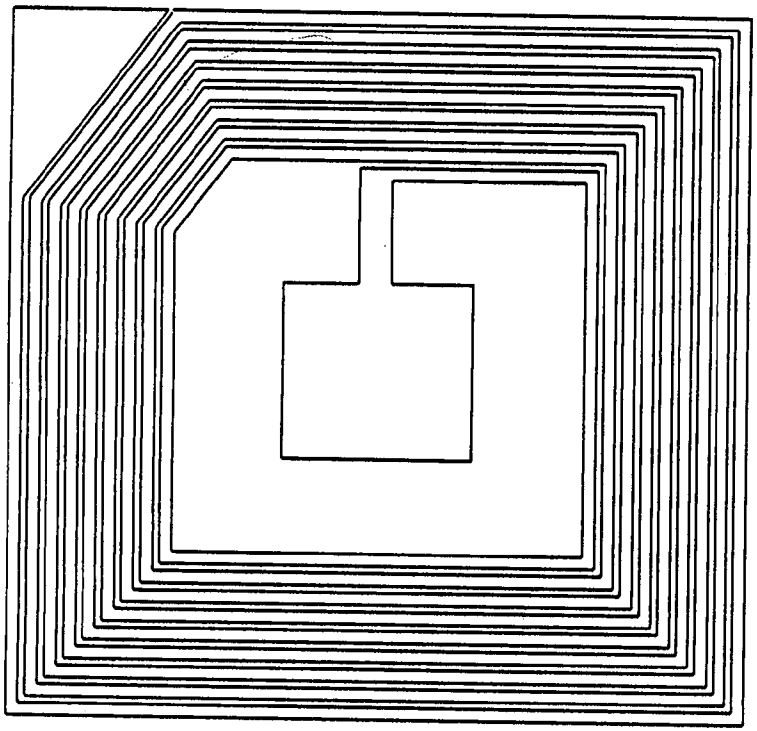
FIG. 1A PRIOR ART
FIG. 1A is an enlarged view of a first side of a printed circuit security tag in accordance with the prior art.
Figure 2:
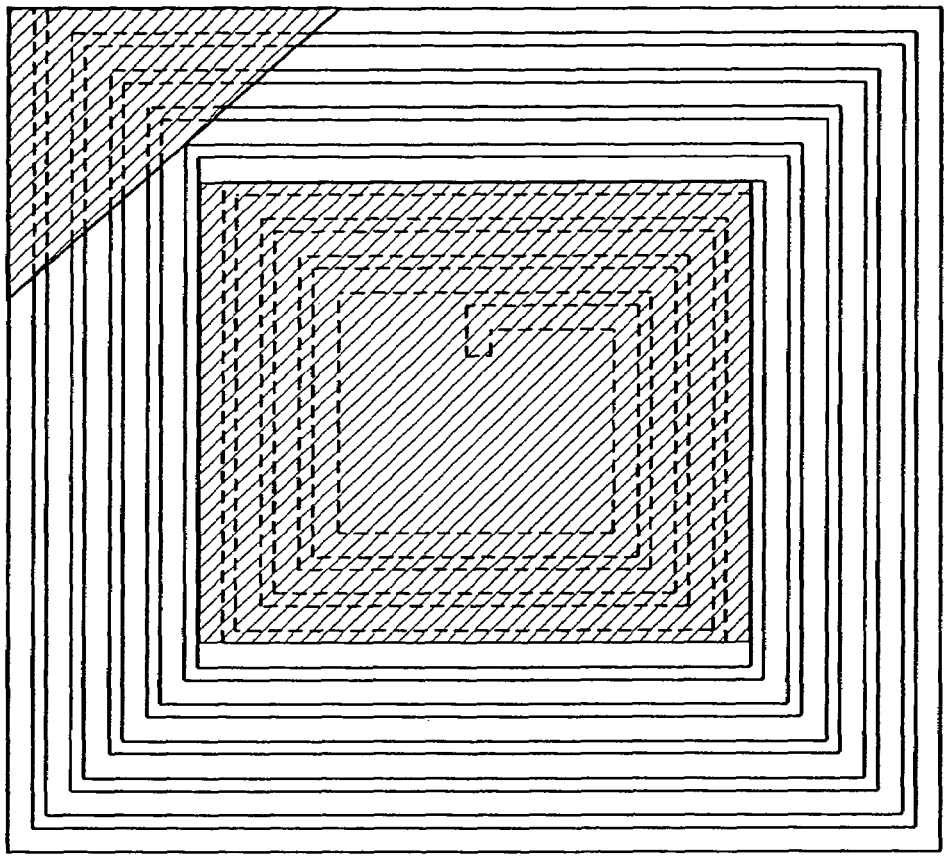
FIG. 2 PRIOR ART
FIG. 2 is an enlarged plan view of a first side of another printed circuit security tag in accordance with the prior art.
Figure 3B:
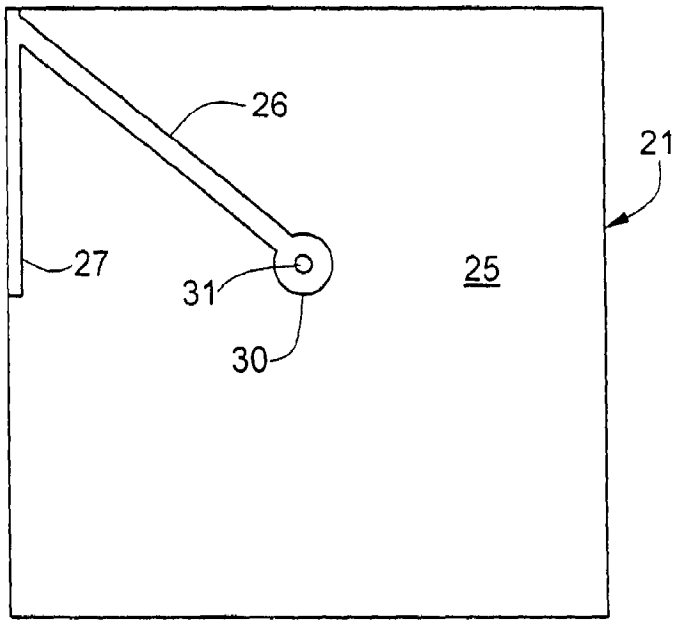
FIG. 3B is an enlarged plan view of a second side of the printed circuit security tag of FIG. 3A.
Figure 3A:
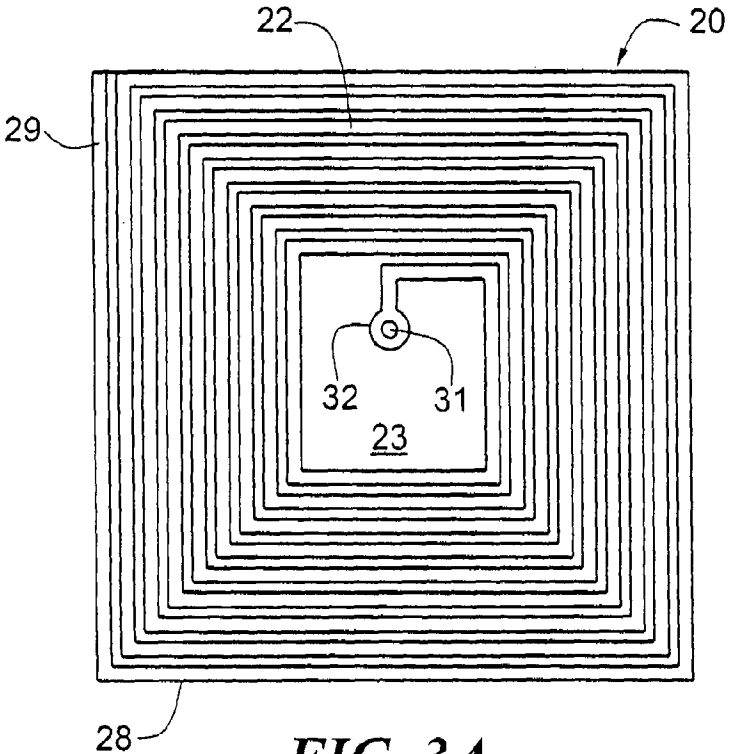
FIG. 3A is an enlarged plan view of a first side of a printed circuit security tag in accordance with a preferred embodiment of the present invention.

FIGS. 3A and 3B illustrate the features of a security tag 20 fabricated in accordance with the preferred embodiments of the present invention. As is well known in the art, the tag 20 is adapted to be secured on/in or otherwise borne by an article or item, or the packaging of such article, for which security or surveillance is sought. The tag 20 may be secured to the article or its packaging at a retail or other such facility, or as is often preferred, secured or incorporated into the article or its packaging by either the manufacturer or wholesaler of the article or a packaging specialist engaged by them. The tag 20 is employed in connection with an electronic article security system (not shown), particularly an electronic article security system of the radio frequency or RF type. Such electronic article security systems are well known in the art and therefore a complete description of the structure and operation of such electronic article security systems is not necessary for an understanding of the present invention. Suffice it to say that such electronic article security systems establish a surveilled area or zone defined by portals generally positioned at an entrance or exit of a facility such as a retail store. The security system's function is to detect the presence within the surveilled zone of an article having an active security tag secured thereto or secured to the corresponding packaging.

Figure 4:
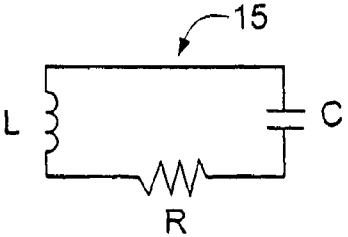
FIG. 4 is an electrical schematic of a resonant circuit used in a preferred embodiment of a security tag of the present invention.

With reference to FIG. 4, an electrical schematic diagram of the security tag 20 is shown. In the case of the present embodiment, the security tag 20 includes components, hereinafter described in greater detail, which establish a resonant circuit 15 that resonates when exposed to electromagnetic energy at or near a predetermined detection resonant frequency. A typical electronic article security system employing the tag 20 includes means for transmitting into or through the surveillance zone electromagnetic energy at or near the resonant frequency of the security tag 20 and means for detecting a field disturbance that the presence of an active resonant circuit security tag causes, thereby establishing the presence of a security tag 20 and thus a protected article within the surveillance zone. The resonant circuit 15 may comprise one or more inductive elements electrically connected to one or more capacitive elements. In a preferred embodiment, the resonant circuit is formed by the combination of a single inductive element, L, electrically connected with a single capacitive element or capacitance C in a series loop. However, multiple inductor and capacitor elements could alternatively be employed. The size of the inductor L and the value of the capacitor C are determined by the desired resonant frequency of the resonant circuit. In the presently preferred embodiment, the tag 20 preferably resonates at or near 8.2 MHz, which is one commonly employed frequency used by electronic security systems from a number of manufacturers. It will be apparent to those of ordinary skill in the art, however, that the frequency of the EAS system may vary according to local conditions and regulations. Thus, this specific frequency is not to be considered a limitation of the present invention. Deactivation of the tag, which typically occurs at the point of sale or checkout counter, prevents the resonant circuit from resonating within the detection frequency range so that the electronic security system no longer detects the article passing through the surveillance zone of the electronic security system.

FIGS. 3A and 3B illustrate opposite sides or principal surfaces of a preferred physical embodiment of the security tag 20. In its preferred embodiment, the tag 20 comprises a generally square, planar insulative or dielectric substrate 21 which maintains its dielectric integrity when flexed. The substrate 21 may include any inorganic or polymeric material as long as the substrate is insulative and has suitable dielectric and mechanical properties. Ideally, the substrate 21 consists of an extremely thin layer (less than 0.2 micron thick) of a flexible insulating material with a low dissipation factor (a property that enhances the Q of a resonant circuit). In this invention the preferred embodiment of the substrate can take either of two forms, one incorporating inorganic materials, the other incorporating polymeric materials.

In the preferred embodiment incorporating inorganic dielectric materials, the substrate 21 can be fabricated by first applying a small dot of suitable marking material to one surface of a sheet or web of aluminum foil 2 mils thick. The aluminum foil with the dot is then anodized by the same type of electrochemical process that is used to convert aluminum foil into substrate materials for wound electrolytic capacitors. This process can be precisely controlled to develop on the surface of the aluminum foil a uniform, pinhole-free insulating layer of alumina (aluminum oxide) that is only a few hundred Angstroms thick. In this thickness range, alumina has a breakdown voltage in the range of 30–100 volts, which is well within the range of voltages induced in the resonant tag circuits by the output of the conventional deactivation units that are widely installed in retail electronic article surveillance systems. The dot is then removed by chemical or mechanical means, leaving a void or via hole in the layer of anodized material. The anodized layer is then vacuum metalized with a layer of aluminum or copper 1500–3000 Å thick to form a second conductive layer, a process which also metallizes the via hole to interconnect the two layers of conductive material. Since this metalized substrate construction incorporates a dielectric layer that is less than $1/100^{th}$ mil thickness of a conventional polyethylene dielectric layer, it is well-suited to the fabrication of capacitor elements that call for high capacitance values in a small area. The ability to form a small via hole to interconnect the two conductive surfaces of the substrate also addresses the goal of maximizing the tag surface area available for the inductor pattern.

The preferred use of an aluminum anodizing process to form insulating layer 21 suggests that other aluminized materials, such as electrodeposited copper foil vacuum metalized with aluminum on one side or aluminum clad copper foil, could also be used as the starting material. Indeed, because electrodeposited copper is easier to etch in fine line patterns than rolled aluminum foil and presents less of a problem with regard to disposal of the spent etchant, there is much to recommend the first of these two alternative starting materials. The alumina layer can alternatively be formed by sputtering aluminum in a reactive atmosphere to produce the aluminum oxide layer. The sheet or web need not be aluminum or aluminum coated but can be any metal on which the sputtered layer is applied.

It will be recognized by those skilled in the art that other inorganic dielectric materials such as tantalum oxide, silica or zirconia or multilayer combinations of such materials may alternatively be employed to form the insulating layer 21. These materials may be applied by sputtering or vacuum deposition methods, as is also the case with alumina. In addition to aluminum and copper other conductive materials such as gold, nickel and tin can be applied to insulating layer 21 without changing the nature of the resonant circuit or its operation. These conductive materials can be applied to the surface of insulating layer 21 by any one or a combination of methods known to those familiar with printed circuit fabrication practices, among them but not limited to: coating; screen printing; electrochemical deposition; vacuum deposition; etc.

In the preferred embodiment incorporating polymeric dielectric materials, the substrate layer 21 can be formed by using a flexographic printer to apply to the surface of the aluminum foil a toluene-based solution of polystyrene modified by a small amount, 1–2% by weight, of a flexibilizing agent such as Kraton rubber. The printed coating, which incorporates a via hole, is then dried to form a uniform, pinhole-free dielectric layer. The surface of the polystyrene is then vacuum metalized with a layer of aluminum or copper 1500–3000 Å thick to form a second conductive layer, a process that also metallizes the via hole to interconnect the two layers of conductive material. Although much thicker than the Angstrom level thickness of the inorganic dielectric layer, the polymer dielectric layer described above is still only 10% of the thickness of a conventional 1 mil thick polymer dielectric layer; as such, it is also well-suited to the fabrication of capacitor elements that call for high capacitance values in a small area.

Alternatively, the starting foil may be copper or some other appropriate metal in a suitable gauge. The dielectric layer may also be formed by extrusion coating the polymeric material onto the surface of the starting foil, then opening via holes in the coating with a laser or other means. Those skilled in the art will also recognize that other polymeric materials such as polyethylene, polypropylene, or their co-polymers, as well as any of several fluoropolymers, may alternatively be employed in forming the substrate 21 and that two or more layers of different polymeric materials may be employed in the form of a multilayer dielectric composite. It is also contemplated that a treatment layer may be applied to a surface of the base metal to enhance the bonding of the base metal to the particular polymeric material.

Each side of the metalized composite substrate is then printed with a UV-curable etch resist in its respective circuit pattern. Surface 23 of substrate 21, the 2 mil thick aluminum foil layer, is printed with an image that includes the inductor-capacitor patterns 22, 29 and via hole 31; surface 25 of substrate 21, the thin second conductive layer, is printed with an image that includes the matching capacitor plate 27, via hole land 30, and connection segment 26. The resist-coated substrate is then exposed to a brief chemical etching step which completely removes the unprotected areas of the Angstrom-thick metal on surface 25 of the substrate. Since this brief exposure removes only a thin layer from the unprotected areas of the aluminum foil on surface 23, the mechanical integrity of the composite substrate is maintained for handling purposes. A sheet of 1 mil thick polyethylene film coated with a pressure-sensitive adhesive is then laminated to surface 25, thereby encapsulating the circuit elements formed thereon. In addition to forming the second side outer layer in the finished tag construction, the laminated polyethylene film provides mechanical support for the substrate in the next chemical etching step wherein the unprotected 2 mil thick aluminum on surface 23 is selectively removed to form the inductor and capacitor plate patterns. A sheet of label stock paper coated with a pressure-sensitive adhesive is then laminated to this side to complete the construction of the finished tag.

The first side (22, 29, 31, and 32) and second side (26, 27, and 31) conductive patterns establish at least one resonant circuit, such as the resonant circuit 15, having a resonant frequency within the predetermined detection frequency range of an electronic article surveillance system used with the security tag 20. As previously discussed in regard to FIG. 4, the resonant circuit 15 is formed by the combination of a single inductive element, inductor, or coil L, electrically connected with a single capacitive element or capacitance C in a series loop. The inductive element L is formed by coil portion 28 of the first side conductive pattern 22. The capacitive element C is comprised of a first plate formed by the beginning segment 29 of coil pattern 28 and a second plate formed by a corresponding segment 27. As will be appreciated by those skilled in the art, the first and second plates are in registry and are separated by the dielectric substrate 21. The first plate of the capacitor element C, conductive segment 29, is integral with and therefore electrically connected to inductor coil 28. The second plate of the capacitor element C, conductive segment 27, is electrically connected to land 30 by conductive segment 26. Land 30 contains a conductive element 31 that passes through the substrate 21 and forms an electrical connection to land 32 on surface 23. Land 32 forms the other end of inductor coil 28 and thereby completes the circuit path connecting the inductive element L to the capacitor element C in series to form the resonant circuit 15. In the preferred embodiment the conductive element 31 is formed by vacuum metallizing the walls of a via hole formed in the insulative substrate 21. However, conductive element 31 can be formed by a variety of methods well known to those skilled in the art of printed circuit fabrication, among them electroless metal deposition, electrolytic plating, welding, soldering, staking, crimping, conductive polymers, etc. It will also be obvious to those skilled in the art that the positions of the capacitor plates and land area containing the side-to-side connection can be interchanged relative to the inductor coil without changing the nature of the resonant circuit or its operation, i.e., the capacitor plates can be located within the coil and the land area containing the side-to-side connection placed within the initial segment 29 of the coil.

When security tag 20 embodying the present invention is subjected to a radio-frequency signal at the resonant frequency of its resonant circuit, of relatively low intensity, but still sufficient to enable an electronic anti-shoplifting system to detect the tag's presence, then the capacitor element C formed by plate segments 27 and 29 will remain unaffected, and the tag will remain capable of causing an alarm. The capacitor element will likewise remain unaffected by exposure to static discharge. On the other hand, when the tag 20 is subjected to a radio-frequency signal at the same frequency but of sufficiently increased intensity by a deactivating unit provided for that purpose, then the very thin dielectric layer separating the plates of capacitor element C will break down under the stress of the induced voltage, causing the capacitor to short circuit and rendering the resonant circuit tag incapable of causing an alarm.

The invention is not to be limited by the embodiments which have been shown and described and is intended to embrace the full spirit and scope of the appended claims.

What is claimed is:

1. A metalized dielectric substrate comprising:

a flexible substantially planar dielectric substrate having a thickness of no more than about 2.5 microns and a first side and a second side;

a first flexible planar conductive layer on said first side of said dielectric substrate wherein said first conductive layer is at least 10 microns thick; and a second planar conductive layer on said second side of said dielectric substrate.

2. The metalized substrate of claim 1 wherein the dielectric substrate is an inorganic dielectric material.

3. The metalized substrate of claim 1 wherein the dielectric substrate is a polymeric dielectric material.

4. The metalized substrate of claim 1 wherein there is at least one conductive element connecting said second conductive layer to said first conductive layer.

5. The metalized substrate of claim 2 wherein the planar dielectric substrate is alumina.

6. The metalized substrate of claim 4 wherein the planar dielectric substrate is alumina.

7. The metalized substrate of claim 2 wherein the first conductive layer is aluminum foil or aluminized copper foil and the second conductive layer is copper or aluminum.

8. The metalized substrate of claim 4 wherein the first conductive layer is aluminum foil or aluminized copper foil and the second conductive layer is copper or aluminum.

9. The metalized substrate of claim 2 wherein the first conductive layer has an aluminum surface and wherein the dielectric substrate is an anodized layer on the first conductive layer.

10. The metalized substrate of claim 4 wherein the first conductive layer has an aluminum surface and wherein the dielectric substrate is an anodized layer on the first conductive layer.

11. The metalized substrate of claim 2 wherein the dielectric substrate is a sputtered layer on the first conductive layer and the first conductive layer is copper foil or aluminum foil.

12. The metalized substrate of claim 4 wherein the conductive element is a via hole through the dielectric substrate and containing material of the second conductive layer.

13. The metalized dielectric substrate of claim 3 wherein the first side of the dielectric substrate is bonded to one side of the first conductive layer; and the second conductive layer is formed on the second side of said dielectric layer.

14. The metalized substrate of claim 13 wherein the polymeric dielectric material is selected from the group consisting of polystyrene; polyethylene; polypropylene; their co-copolymers; or a fluoropolymer.

15. The metalized substrate of claim 13 wherein the first conductive layer is copper foil or aluminum foil and the second conductive layer is aluminum or copper.

16. The metalized dielectric substrate of claim 13 wherein the polymeric dielectric material comprises at least two layers of different polymeric materials.

17. The metallized substrate of claim 1 wherein at least one of the first and second planar conductive layers has a conductive pattern.

18. The metallized substrate of claim 17 wherein the conductive pattern comprises an inductor and a capacitor plate.

19. The metallized substrate of claim 1 wherein the first conductive layer has a first conductive pattern comprising an inductor and a capacitor plate;

wherein the second conductive layer has a second conductive pattern comprising a capacitor plate in registration with the capacitor plate of the first conductive pattern; and a conductive element connecting the first and second conductive patterns to form a resonant circuit.

20. The metallized substrate of claim 1 wherein the first and second planar conductive layers have conductive patterns providing a circuit.

* * * * *